United States Patent [19]

Bares et al.

[11] Patent Number: 4,967,238

[45] Date of Patent: Oct. 30, 1990

[54] CLEANING PERFORMANCE MONITOR

[75] Inventors: Jan Bares; Richard H. Tuhro, both of Webster, N.Y.

[73] Assignee: Xerox Corporation, Stamford, Conn.

[21] Appl. No.: 288,603

[22] Filed: Dec. 22, 1988

[51] Int. Cl.[5] ..... G03G 21/00; G03G 15/06

[52] U.S. Cl. ..... 355/296; 355/297; 355/245; 355/246

[58] Field of Search ..... 355/296, 297, 300, 301, 355/303, 305, 246

[56] References Cited

U.S. PATENT DOCUMENTS

| | | | |
|---|---|---|---|
| 4,046,471 | 9/1977 | Branham et al. | 355/14 |
| 4,099,861 | 7/1978 | Abel | 355/15 |
| 4,204,725 | 5/1980 | Distefano et al. | 355/3 R |
| 4,272,182 | 6/1981 | Abe et al. | 355/246 |
| 4,273,843 | 6/1981 | Fujita et al. | 355/246 |
| 4,279,498 | 7/1981 | Eda et al. | 355/246 |
| 4,468,112 | 8/1984 | Suzuki et al. | 355/246 |
| 4,506,973 | 3/1985 | Ernst | 355/296 |
| 4,508,446 | 4/1985 | Imai | 355/246 |
| 4,551,004 | 11/1985 | Paraskevopoulos | 355/246 |
| 4,705,388 | 11/1987 | Huntjens et al. | 355/15 |

FOREIGN PATENT DOCUMENTS

| | | | |
|---|---|---|---|
| 0153564 | 6/1988 | Japan | 355/296 |
| 0239483 | 10/1988 | Japan | 355/296 |

OTHER PUBLICATIONS

J. Bares, "A Method of Estimating Resistance to Abrasion"; Journal of Applied Polymer Science; vol. 14; pp. 1473–1475(1970).

*Primary Examiner*—Arthur T. Grimley
*Assistant Examiner*—Nestor R. Ramirez

[57] ABSTRACT

An arrangement for detecting toner or debris deposits on an imaging surface is arranged downstream from the cleaning station. The imaging surface is illuminated with a light source, a light intensity detecting sensor arrangement is provided to view the illuminated surface and produce a signal representative of detected light intensity, and a response signal is produced indicative of the condition of the surface.

41 Claims, 6 Drawing Sheets

CLEANING PERFORMANCE MONITOR

This invention relates to reproduction apparatus and more particularly to cleaning apparatus including a sensor arrangement for monitoring cleaning performance.

BACKGROUND OF THE INVENTION

In eletrophotographic applications such as xerography, an imaging surface is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the imaging surface is cleaned from the surface. The process is well known and useful for light lens copying from an original and printing applications from electronically generated or stored originals, where a charged surface may be imagewise discharged in a variety of ways. Ion projection devices where a charge is imagewise deposited on a imaging surface operate similarly.

Although a preponderance of the toner forming the image is transferred to the paper during the transfer step, some toner invariably remains on the imaging surface, it being held thereto by relatively high electrostatic and/or mechanical forces. Additionally, paper fibers, Kaolin and other debris have a tendency to be attracted to the imaging surface. It is essential for optimum operation that the toner remaining on the surface be cleaned thoroughly therefrom. Blade cleaning is a highly desirable method for removal of residual toner and debris (hereinafter, collectively referred to as "toner") from a imaging surface, because it provides a simple inexpensive structure compared to the various fiber or magnetic brush cleaners that are well known in the dry electrophotography art. In a typical application, a relatively thin elastomeric blade member is provided and supported adjacent and transversely across the imaging surface with a blade edge chiseling or wiping toner from the surface. Subsequent to release of toner from the surface, the released toner accumulating adjacent the blade is transported away from the blade area by a toner transport arrangement or gravity. Unfortunately, blade cleaning suffers from certain deficiencies, primarily resulting from the frictional sealing contact which must be maintained between the blade and the imaging surface. Friction between the surfaces causes wearing away of the blade edge, and damaging wearing contact with the imaging surface. In addition to the problem of wear, which is more or less predictable over time, blades are also subject to unpredictable failures. The impact from carrier beads remaining on the imaging surface subsequent to development may damage the blade, and sudden localized increases in friction between the blade and surface may cause the phenomenon of tucking, where the blade cleaning edge becomes tucked underneath the blade, losing the frictional sealing relationship required for blade cleaning. These problems require removal and replacement of the blade.

It has been determined that at failure, streaks of toner and debris begin to occur, extending along the imaging surface in the process direction. Eventually, failure is noted by the user. It would be highly desirable to provide a sensor that detects cleaner failure, so that immediate corrective action may be taken by a machine subsystem to replace or rejuvenate the cleaner, or by service personnel notified remotely by a signal from the machine, or by an operator responding to a machine status message.

U.S. Pat. No. 4,705,388 to Huntjens et al. shows an arrangment for cleaning an imaging surface with a layer of tacky material that requires periodic rejuvenation. Light reflection from the tacky member is measured and compared with a standard to determine whether rejuvenation is required. U.S. Pat. No. 4,099,861 to Abel provides a monitor for the exhaust path of the cleaning apparatus, including light emitting diode (LED) downstream of the final filter and an optical sensor positioned to view the LED, which detects the concentration of particulate toner in the exhaust path. U.S. Pat. No. 4,046,471 to Branham et al. teaches a dual mode electrophotographic apparatus in which a laser is used both for formation of a latent image and to erase the borders around images when the device is used in light lens copying mode. U.S. Pat. No. 4,204,725 to DiStefano et al. teaches that a laser may be used for both formation of a latent image and for interrogation of a latent image on a surface to derive an electronic representation thereof. In the article, "A Method of Estimating Resistance to Abrasion", Journal of Applied Polymer Science, Vol. 14, pp. 1473–1475 (1970) by J. Bares, loss of reflectivity of a shiny surface is measured by decrease in specular surface reflectance.

SUMMARY OF THE INVENTION

In accordance with the invention there is provided an arrangement for monitoring cleaning performance in an electrostatographic device in which streaks on the imaging surface resulting from cleaning station failures are monitored with an electronic imaging arrangement.

In accordance with one aspect of the invention, an arrangement for detecting toner or debris deposits on an imaging surface is arranged downstream from the cleaning station. The imaging surface is illuminated with a light source, a light intensity detecting sensor arrangement is provided to view the illuminated surface and produce a signal representative of detected light intensity, and a response signal is produced indicative of the condition of the surface.

In accordance with another aspect of the invention, the sensor arrangement is supported to sense the intensity of light specularly reflected from the imaging surface, from a light source supported to illuminate the imaging surface at a relatively shallow angle that provides a better contrast of contamination on the imaging surface. Another sensor arrangement may also be provided to measure the intensity of light diffusely reflected from the imaging surface, located at an angle other than the specular reflection angle. A ratio of specular and diffuse components of reflected light represents true reflectance of the imaging surface, even with the output of the light source or the input of the sensors contaminated a manner effecting the optical characteristics of the devices.

In accordance with yet another aspect of the invention, in electrostatographic devices that provide imagewise discharge of a photoconductive surface, the light source may originate at the imaging laser of a laser imaging device, or the erase lamp for illuminating a photoconductive surface to dissipate residual charge on the photoconductive surface prior to initial charging of the surface prior to imaging.

In accordance with still another aspect of the invention, irrespective of the nature of the imaging device, a light source and sensor arrangement may be provided for monitoring cleaning efficiency with a light source such as an LED or laser diode, and a complementary reflected light sensor arrangement that is moved across the surface. Alternatively, the laser may be swept across the surface, with an array of sensors arranged across the surface for detection of incremental portions of the sweeping path. Yet another alternative may provide an array of LED's or laser diodes arranged across the surface, and a complementary array of sensors arranged across the surface arranged for detection of light from the LED's or laser diodes.

These and other aspects of the invention will become apparent from the following description used to illustrate a preferred embodiment of the invention read in conjunction with the accompanying drawings in which.

Figure 1:
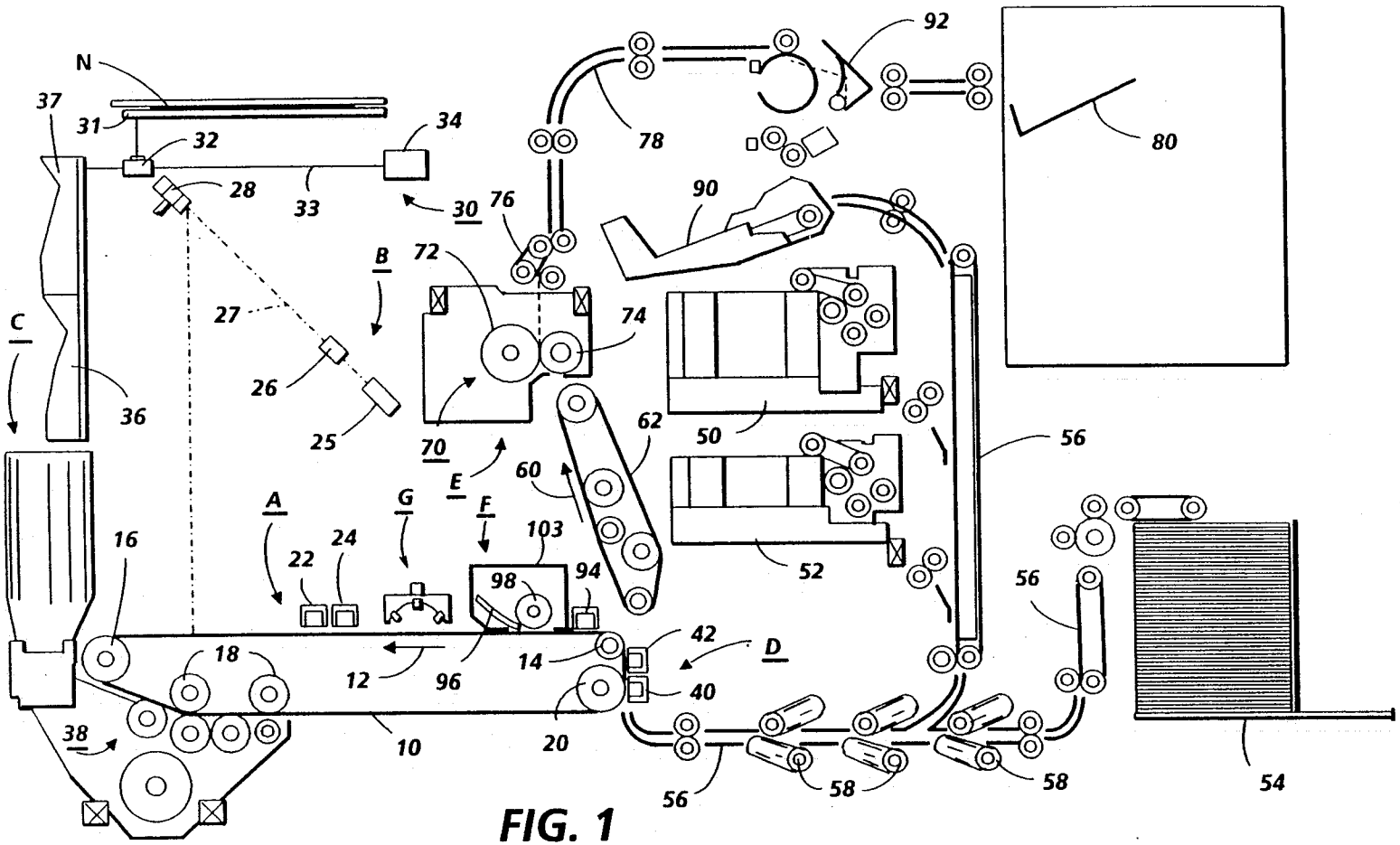
FIG. 1 is a schematic elevational view depicting an electrophotographic printing machine incorporating the present invention.

Referring now to the drawings, where the showings are for the purpose of describing a preferred embodiment of the invention and not for limiting same, the various processing stations employed in the reproduction machine illustrated in FIG. 1 will be described only briefly. It will no doubt be appreciated that the various processing elements also find advantageous use in electrophotographic printing applications from an electronically stored original.

A reproduction machine in which the present invention finds advantageous use utilizes a photoreceptor belt 10. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive.

Belt 10 is maintained in tension by a pair of springs (not shown) resiliently urging tension roller 16 against belt 10 with the desired spring force. Both stripping roller 18 and tension roller 16 are rotatably mounted. These rollers are idlers which rotate freely as belt 10 moves in the direction of arrow 16.

With continued reference to FIG. 1, initially a portion of belt 10 passes through charging station A. At charging station A, a pair of corona devices 22 and 24 charge photoreceptor belt 10 to a relatively high, substantially uniform negative potential.

At exposure station B, a laser light source 25 is modulated in accordance with the content of an image input signal by acousto-optic modulator 26 to provide imaging beam 27. Beam 27 is scanned across photoreceptor belt 10 at exposure station B by the mirrored facets of a rotating polygon 28 to imagewise expose photoreceptor belt 10 and create a latent electrostatic image represented by the image input signal to modulator 26. Of course, the latent image could also be formed with light, imagewise reflected from an original document placed on a platen.

An input scanner 30 has one or more linear scanning arrays (not shown) such as charge coupled devices (CCD's) or photodiodes mounted below a transparent platen 31 on a reciprocating carriage 32. A carriage screw 33 driven by a reversible motor 34 moves scanning carriage 32 in either forward or reverse scanning directions. A suitable optical system (not shown) is provided to focus the scanning array on a line-like segment of platen 31 and the document original N resting thereon. The scanning array provides an electronic representation of the image thus scanned, which after suitable processing is input to a printer memory and stored pending use.

Memory 36 in the form of a hard disk, in conjunction with programmable controller 37, stores for execution machine operating programs and job programs. Image data acquired by image scanner, or otherwise may also be stored in memory 36, and controller 37 may also be used to implement various desirable image processing functions for the acquired image data.

Thereafter, belt 10 advances the electrostatic latent image to development station C. At development station C, a magnetic brush developer unit 38 advances a developer mix (i.e. toner and carrier granules) into contact with the electrostatic latent image. The latent image attracts the toner particles from the carrier granules thereby forming toner powder images on photoreceptor belt 10.

Belt 10 then advances the developed latent image to transfer station D. At transfer station D, a sheet of support material such as a paper copy sheet is moved into contact with the developed latent images on belt 10. First, the latent image on belt 10 is exposed to a pretransfer light from a lamp (not shown) to reduce the attraction between photoreceptor belt 10 and the toner powder image thereon. Next corona generating device 40 charges the copy sheet to the proper potential so that it is tacked to photoreceptor belt 10 and the toner powder image is attracted from photoreceptor belt 10 to the sheet. After transfer, a corona generator 47 charges the copy sheet to an opposite polarity to detack the copy sheet for belt 10, whereupon the sheet is stripped from belt 10 at stripping roller 14.

Sheets of support material are advanced to transfer station D from supply trays 50, 52 and 54, which may hold different quantities, sizes and types of support materials. Sheets are advanced to transfer station D along conveyor 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72. In this manner, the toner powder image is permanently affixed to the sheet.

After fusing, copy sheets bearing fused images are directed through decurler 76. Chute 78 guides the advancing sheet from decurler 76 to catch tray 80 or a finishing station for binding, stapling, collating etc. and removal from the machine by the operator. Alternatively, the sheet may be advanced to a duplex tray 90 from duplex gate 92 from which it will be returned to the processor and conveyor 56 for receiving second side copy.

A pre-clean corona generating device 94 is provided for exposing the residual toner and contaminants (hereinafter, collectively referred to as toner) to positive charges to thereby narrow the charge distribution thereon for more effective removal at a cleaning station F, more completely described hereinafter. Residual toner remaining on photoreceptor belt 10 after transfer may be reclaimed and returned to the developer station C by any of several well known reclaim arrangements.

Cleaning station F includes a blade cleaning arrangement, having a blade 96 for releasing toner from photoreceptor belt 10 and toner transport 98 for removal of toner accumulating adjacent the blade subsequent to removal.

As thus described, a reproduction machine in accordance with the present invention may be any of several well known devices. Variations may be expected in specific processing, paper handling and control arrangements without affecting the present invention. While the described embodiment provides imagewise exposure with a laser, light lens, ion deposition, or other arrangements for producing a latent image on an imaging surface are also possible.

Figure 2:
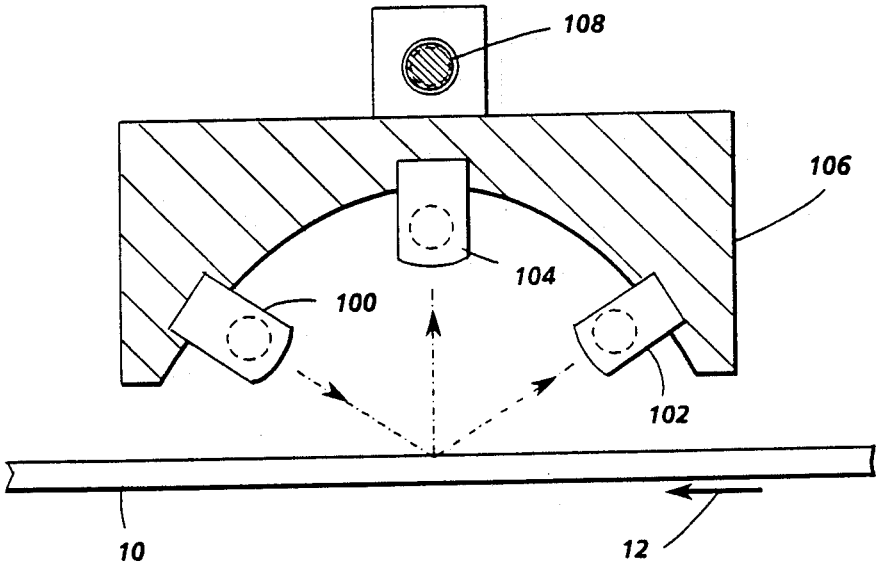
FIG. 2 is a schematic illustration of a cleaner failure detector incorporated in the machine of FIG. 1.

In accordance with one embodiment of the present invention, downstream of the cleaning station F and upstream from charging station A, a cleaning performance monitor G is provided. With reference to FIG. 2, cleaning monitor G in one simple form includes a light source 100 such as a light emitting diode (LED) or laser diode supported to illuminate the surface of photoreceptor belt 10 preferably from a shallow angle in the range of 5°–35°, with respect to photoreceptor belt 10. Preferably at a position for detection of the specular component of reflection, a light intensity responsive device, such as a photodiode 102 is provided. A second photodiode 104 may also be provided at a position for detection of the diffuse component of reflected light. The combination of light source and light detectors may be arranged within a housing 106 and supported for movement across photoreceptor belt 10, transverse to the direction of photoreceptor belt 10 movement, on a drive screw 108 or pulley arrangement, appropriately coupled to a motor (not shown). In operation, LED 100 preferably illuminates the surface at a shallow angle, which creates a good contrast between toner or debris, and the photoreceptor surface, to aid in detection on light intensity variations. The monitoring arrangement including light source and light detectors may be periodically or continually driven across the surface. If will of course be appreciated that if the cleaner monitor is used with an imaging surface that is not photoconductive, it is not required that the cleaner monitor be located before the charging station. In that case, the cleaner monitor may be located anywhere along the surface where the surface is not imagewise developed with toner.

Figure 3:
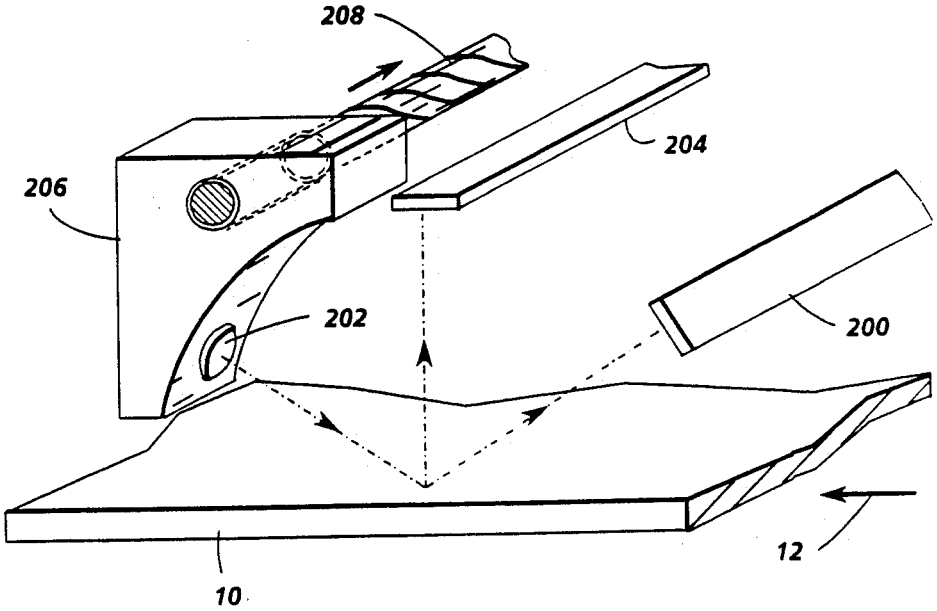
FIG. 3 illustrates an alternative embodiment of a cleaner failure detector.

With reference to FIG. 3, in another embodiment of the invention, an array 200 of photosensitive elements such as charge coupled devices (CCD's) or photodiodes, is arranged across photoreceptor, belt 10, transverse to the direction of photoreceptor belt 10 movement. Array 200 may have a one-to-one correspondence in length to the photoreceptor, where the array is formed from a plurality of butted or staggered shorter arrays, or be provided with an appropriate lens to focus the entire width of the photoreceptor on a shorter array. While the imaging array proposed for image input would certainly be satisfactory, the high resolution desired for such imaging arrays in not required. A light source 202, such as a light emitting diode (LED) or laser diode is arranged for movement across photoreceptor belt 10, transverse to the direction of photoreceptor belt 10 movement, and parallel to array 200, and is supported to illuminate the surface of photoreceptor belt 10 from a shallow angle in the range of 5°–35°. Array 200 is arranged for the detection of the specular component of reflection from the illumination provided by light source 202. A similar second array 204 of photosensitive elements, such a CCD's or photodiodes may be arranged across photoreceptor, belt 10, transverse to the direction of photoreceptor belt 10 movement, for detection of the diffuse component of reflected light. Light source 10 may be supported for movement as described above, in a housing 206 on a drive screw 208 or pulley arrangement, appropriately coupled to a motor (not shown). Of course, the diffuse reflection light detector could be a single photosensitive element, mounted on the moving housing as described in the FIG. 2 embodiment.

Figure 4:
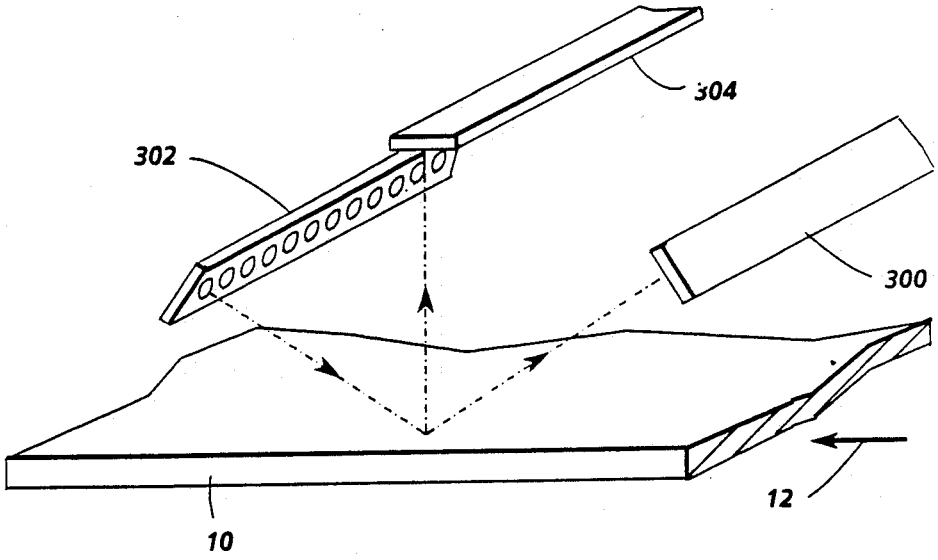
FIG. 4 illustrates another embodiment of a cleaner failure detector.

With reference to FIG. 4, in another embodiment of the invention, an array 300 of photosensitive elements such as charge coupled devices (CCD's) or photodiodes, are arranged across photoreceptor belt 10, transverse to the direction of photoreceptor belt 10 movement. A light source 302, may comprise an array of light emitting diodes (LED) or laser diode arranged supported to illuminate the surface of photoreceptor belt 10 from a shallow angle in the range of 5°–35°. Array 300 is arranged for the detection of the specular component of reflection from the illumination provided by light source 302. A similar second array 304 of photosensitive elements, such a CCD's or photodiodes may be arranged across photoreceptor, belt 10, transverse to the direction of photoreceptor belt 10 movement, for detection of the diffuse component of reflected light. An appropriate focusing arrangements may be employed in the illuminating and detector arrays to prevent stray illumination or detection of light reflected from neighboring photoreceptor areas. This stray reflection is referred to as cross talk. Generally, a substantial portion of the cross talk is eliminated by positioning the array as close to the photoreceptor belt 10, as the runout of the belt allows. It will also be appreciated that the illuminating diodes in array 302 could be turned on sequentially, one at a time to perform a sweep across photoreceptor belt 10. During such a sweep, only one photosensitive element in array 300 will detect the specularly reflected light. Because light detected by any other photodiodes during the sweep will be diffusely reflected light, both specularly reflectivity and diffuse reflectivity could be measured at a single array.

Figure 5:
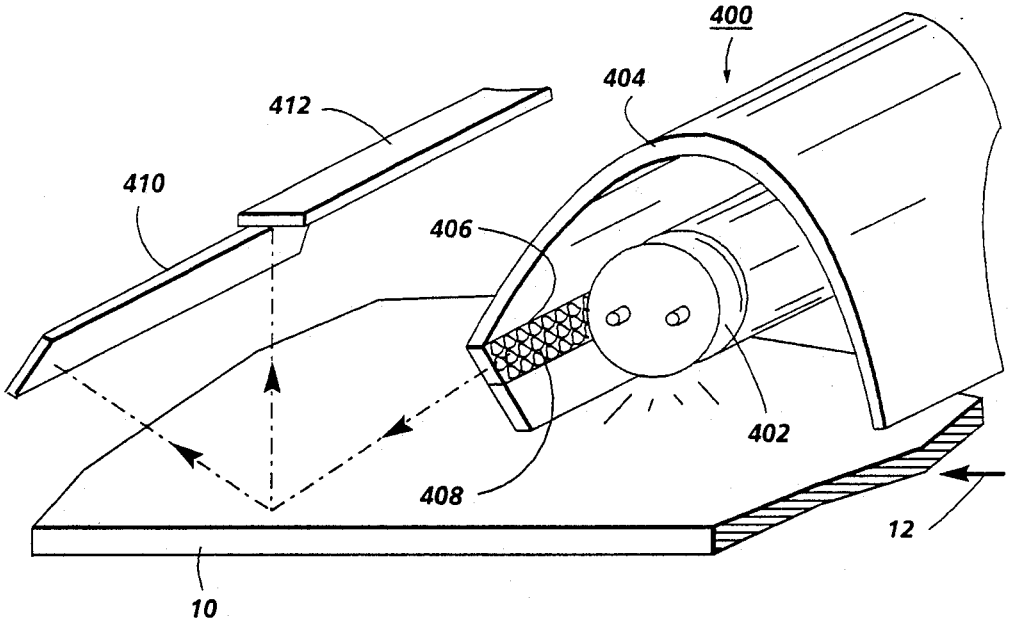
FIG. 5 illustrates yet another embodiment of a cleaner failure detector.

FIG. 5 shows a variation of the previous embodiment, wherein an erase lamp 400, comprising a fluorescent lamp 402 supported within a lamp housing 404 for flood illumination of photoreceptor belt 10 subsequent to cleaning for dissipation of residual charge provides the illumination required for the cleaning monitor station G. Accordingly, a slot 406 is provided along the erase lamp housing, at a position allowing a shallow angle of illumination of the photoreceptor belt, and a lens 408 comprising a bundle of image transmitting lens fibers such as a SELFOC lens array (a trademark of the Nippon Sheet Glass Company Ltd.). An array 410 of photosensitive elements such as charge coupled devices (CCD's) or photodiodes, are arranged across photoreceptor, belt 10, transverse to the direction of photoreceptor belt 10 movement for the detection of light specularly reflected from the surface. A similar second array 412 of photosensitive elements, such a CCD's or photodiodes may be arranged across photoreceptor, belt 10, transverse to the direction of photoreceptor belt 10 movement, for detection of the diffuse component of reflected light. Of course, either the specular or diffuse diffuse reflection light detector could be a single photosensitive element, mounted on the moving housing as described in the FIG. 2 embodiment.

Figure 6:
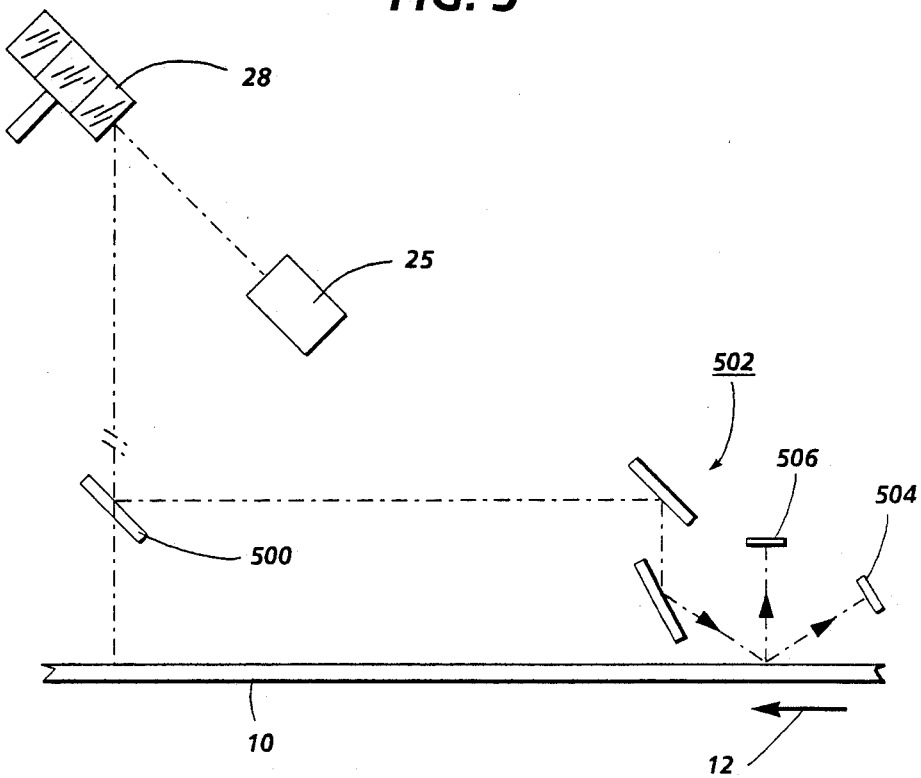
FIG. 6 illustrates still another embodiment of a cleaner failure detector.

FIG. 6 shows a variation of the previous embodiment, wherein laser light source 25 used for imaging is also used for providing the scanning illumination required for the cleaning performance monitor. In the illustrated embodiment, a beam splitter 500 is used to split the light beam and a reflecting mirror arrangement 502 is used to direct light from the laser to the photoreceptor belt 10 at a position suitable for detection by a photosensitive element array 504 for detecting specularly reflectivity and a photosensitive element array 506 for detecting diffuse reflectivity. Because the beam is sweeping across the photoreceptor as part of its imaging function, there is no further requirement of providing for illumination across the surface of the photoreceptor. Additionally, there is a one to one correspondence between points illuminated by the laser, and light detected by the detector elements. Because the beam is also being imagewise attenuated, it is contemplated that monitoring might occur during start up or cycle down of the machine, or during the interdocument periods. It is believed that these test points will provide a representative sampling of cleaning function. Of course, a similar arrangement, not requiring a beam splitter could be moved to the exposure station during such monitoring periods, and removed before imaging again occurs, or the laser beam and detector combination may be arranged at positions such that the detector senses laser light reflected from the photoreceptor without interfering with imaging.

Figure 7:
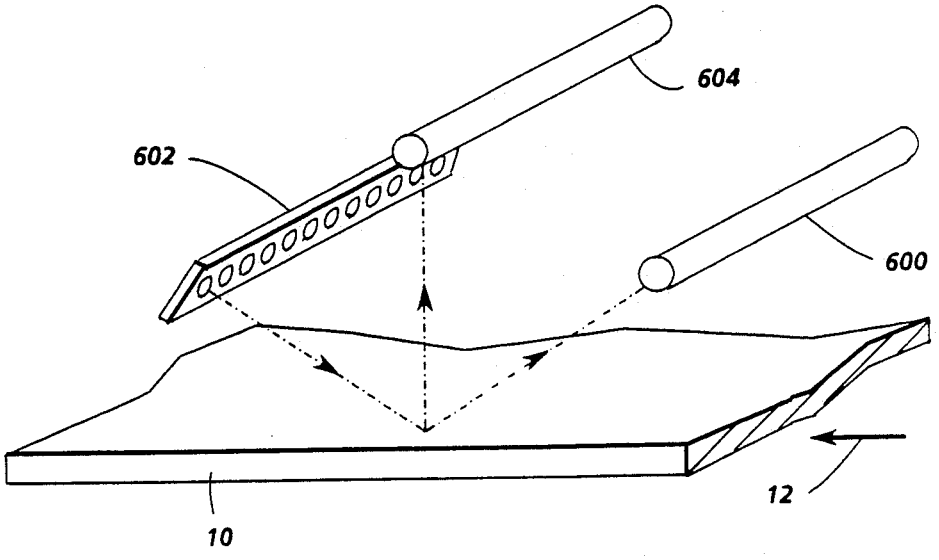
FIG. 7 illustrates another embodiment of a cleaner failure detector.

In accordance with FIG. 7, in yet another embodiment, the light detector could be a light collection means, such as an extended photodiode or a light pipe 600. Thus, instead of detecting the specular reflection from the surface at discrete points therealong, the illumination could be sampled across an entire line of the photoreceptor at a single time as a single integrated value. Light pipe 600 is arranged across photoreceptor belt 10, transverse to the direction of photoreceptor belt 10 movement. A light source 602, may comprise an array of light emitting diodes (LED) or laser diode arranged supported to illuminate the surface of photoreceptor belt 10 from a shallow angle in the range of 5°–35°. Light pipe 600 is arranged for the detection of the specular component of reflection from the illumination provided by light source 602. A similar light pipe 604, or an array of photosensitive elements, such as CCD's or photodiodes, may be arranged across photoreceptor, belt 10, transverse to the direction of photoreceptor belt 10 movement, for detection of the diffuse component of reflected light.

Of course, for the above described embodiments, if the photoreceptor is semi-transparent, the light source and detector may be located on opposite sides of the photoreceptor. For example, a light source may be located to illuminate an area of the photoreceptor from the back side thereof, while a detector or array of detectors is arranged to detect toner illuminated thusly, at the front side of the photoreceptor, or vice versa.

Figure 8:
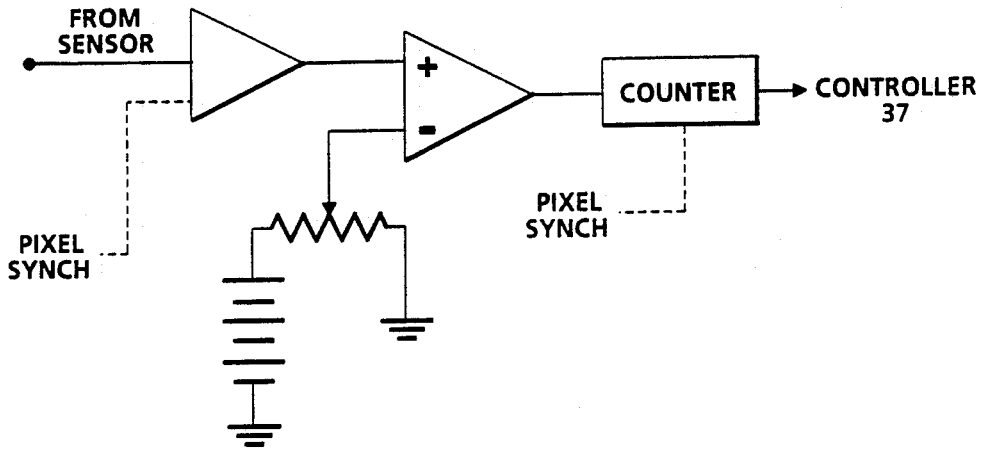
FIG. 8 illustrates one arrangement for processing data derived at of a cleaner failure detector.

In accordance with FIG. 8, a circuit is described for taking the signal from an array of photosensitive elements such as described in FIGS. 3–6, and using the derived information for detecting defects. Accordingly, the signal, periodically derived from array after an integration period wherein the array derives an electrical representation of toner and debris on the surface, is taken from the array, amplified appropriately, and directed to a differential amplifier for detection of defects. One input to the differential amplifier is data derived from the array, while the other input is a threshold value selected to represent the maximum level of toner and debris acceptable on the surface. If the level of debris on the surface exceeds the preselected value, an output indicative of a defect is output to a counter, which provides a defect count to the copier control system. When defects exceed a selected value, a signal indicating the cleaner rejuvenation, repair or replacement is produced. A similar arrangement may be used for the single detector embodiment described in FIGS. 1 and 2. The threshold value may be variable to account for changes in the response of the detection system.

Figure 9:
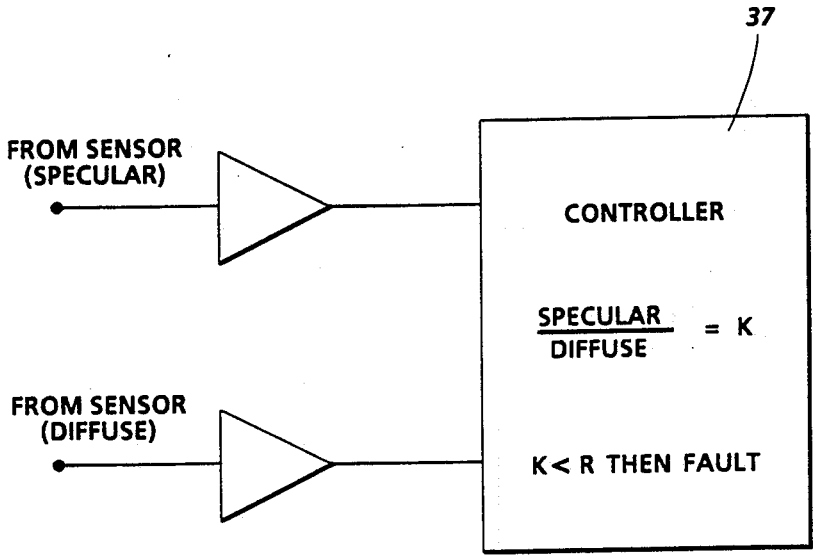
FIG. 9 illustrates another arrangement for processing data derived at of a cleaner failure detector.

In accordance with FIG. 9, another circuit is described for taking the signal from an array of photosensitive elements such as described in FIGS. 3–6, and using the derived information for detecting defects in a manner which accounts for possible contamination of the light sources or sensors with dirt. In this embodiment, the signal from the diffuse illumination detector and the specular illumination detector are derived, and compared to derive a ratio between the two values. While the absolute illumination values will vary with contamination by debris and toner through the machine, the ratio of specular to diffuse reflections will reflect cleaning performance. When the ratio signal reflects a defect in cleaner performance, a signal is produced.

Figure 10:
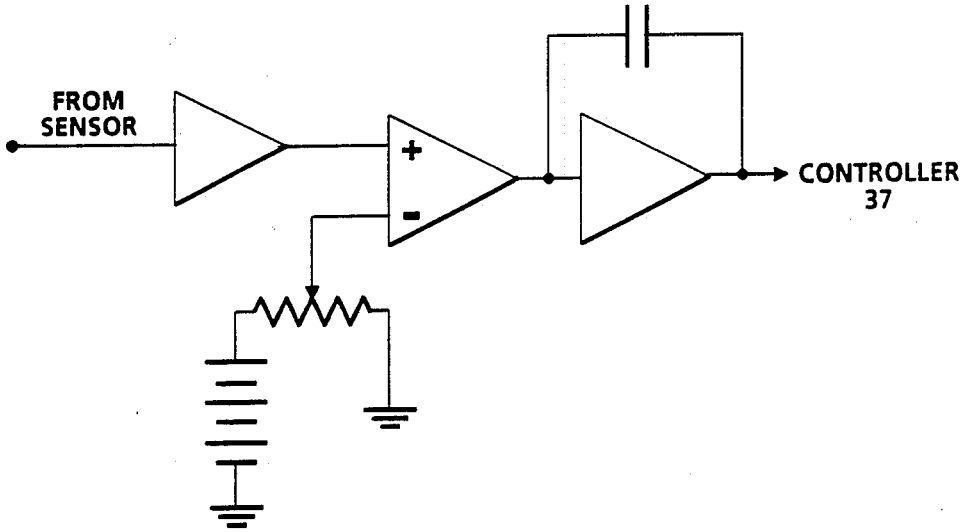
FIG. 10 illustrates still another arrangement for processing data derived at of a cleaner failure detector.
Figure 11:
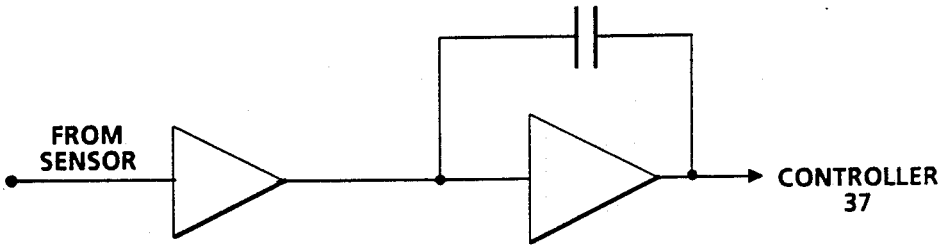
FIG. 11 illustrates still another arrangement for processing data derived at of a cleaner failure detector.

FIGS. 10 and 11 demonstrate alternative processing arrangements for processing the acquired image data. In FIG. 10 the data is compared to a threshold value, and the number of defects summed over time at an integrator. The device controller 37 can take action when this value reaches a selected level of defect counts. Alternatively, as shown in FIG. 11, detected intensity from the detectors may be measured and summed over time, instead of counting individual defects. The device controller 37 can take action when this value indicates that the response of the system has degraded to a level indicating an undesirable amount of toner remaining on the photoreceptor.

It will be appreciated that in the photosensitive element array embodiments, and in the moving housing embodiments which support the light intensity detector for movement across the imaging surface, cleaning failure and position on the imagin surface may be correlated. Thus, data may be derived consecutively.

It will also be appreciated that the fault signals produced can be used in a variety of manners. The fault signal may cause a new cleaning device to be brought into operation, may provide an indication at a control panel, or may provide a remote signal advising service personnel of the requirement of servicing the machine.

To enhance the discrimination and sensitivity of the suggested detectors to the presence of toner, it may be desirable to provide illumination of certain colors or through color transmission filters, and detect reflected light through appropriate filtering arrangements, or with detectors having spectral sensitivities selected according to the reflectance characteristic of the photoreceptor and toner.

The invention has been described with reference to a preferred embodiment. Obviously modifications will occur to others upon reading and understanding the specification taken together with the drawings. This embodiment is but one example, and various alternatives modifications, variations or improvements may be made by those skilled in the art from this teaching which are intended to be encompassed by the following claims.

We claim:

1. In an electrostatographic device including an imaging surface, moving along a continuous path, means for creating a latent image on the imaging surface, means for developing the latent image with toner, means for imagewise transferring the toner to a second surface, a cleaner for removing residual toner remaining on the imaging surface after transfer; and a cleaner performance monitor comprising:

a light source arranged to illuminate the imaging surface after the imaging surface is cleaned and before a latent image is developed on the imaging surface;

a light intensity detector arranged to detect intensity of light reflected from the imaging surface from the light source, and producing a signal indicative of the presence or absence of toner thereon.

2. The device as defined in claim 1 wherein the light source is arranged to illuminate the imaging surface after the imaging surface is cleaned and before a latent image is created on the surface.

3. The device as defined in claim 1 wherein the light source is arranged to illuminate the imaging surface at a relatively shallow angle.

4. The device as defined in claim 3 wherein the light source is arranged to illuminate the imaging surface at an angle between 5° and 35°.

5. The device as defined in claim 1, and including a comparator for comparing the signal from the light detector with a predetermined reference value to determine whether the light intensity detector signal indicative of the presence or absence of toner indicates a cleaning failure.

6. The device as defined in claim 5, and including a counter incremented each time a cleaning failure is noted so that a machine fault may be declared if the number of cleaning failures exceeds a predetermined value.

7. The device as defined in claim 1 wherein the light intensity detector is arranged to detect intensity of light reflected from the imaging surface from the light source at a position for detection of the specular component of reflection.

8. The device as defined in claim 7 and including a second light intensity detector arranged to detect intensity of light reflected from the imaging surface from the light source at a position for the detection of the diffuse component of reflection and producing a signal indicative of the presence or absence of toner on the imaging surface.

9. The device as defined in claim 8 including comparison means for comparing the ratio of specularly reflected light signal to diffusely reflected light signal to derive a constant value therefrom, invariant with contamination of light source, or light detectors.

10. The device as defined in claim 9, and including a comparator for comparing the constant value from the comparison means with a predetermined reference value to determine whether the light intensity detector signal indicative of the presence or absence of toner indicates a cleaning failure.

11. The device as defined in claim 10, and including a counter incremented each time a cleaning failure is noted so that a machine fault may be declared if the number of cleaning failures exceeds a predetermined value.

12. The device as defined in claim 1 wherein the light source is supported on a support housing for movement across and generally transverse the continuous path, between the cleaner and the latent image developing means.

13. The device as defined in claim 12 wherein the light source is supported to illuminate the imaging surface at a shallow angle.

14. The device as defined in claim 13 wherein the light source is arranged to illuminate the imaging surface at an angle between 5° and 35°.

15. The device as defined in claim 12 wherein the light intensity detector is supported on the housing, for movement therewith.

16. The device as defined in claim 15 wherein the light intensity detector is arranged on the housing for detection of the specular component of light reflected from the imaging surface from the light source, and a second light detector is arranged on the housing for detection of the diffuse component of light reflected from the imaging surface from the light source.

17. In an electrostatographic device including a imaging surface moving along a continuous path, means for creating a latent image on the imaging surface, means for developing the latent image with toner, means for imagewise transferring the toner to a second surface, a cleaner for removing residual toner remaining on the imaging surface after transfer; and a cleaner performance monitor comprising:

a light source supported to illuminate the imaging surface between the cleaner and the latent image developing means;

a light intensity detector arranged to detect intensity of light reflected from the imaging surface from the light source, and producing a signal indicative of the presence or absence of toner thereon, the light intensity detector including an array of photosensitive elements, each element producing a signal representative of light intensity detected over a period of time, and arranged for detection of light reflected from the surface from the light source.

18. The device as defined in claim 17 wherein the light source is supported to illuminate the imaging surface at a shallow angle.

19. The device as defined in claim 18 wherein the light source is arranged to illuminate the imaging surface at an angle between 5° and 35°.

20. The device as defined in claim 18 wherein the light source includes an array of light source devices arranged for illumination of the imaging surface.

21. The device as defined in claim 17 wherein the light intensity detector is arranged to detect intensity of light reflected from the imaging surface from the light source at a position for detection of the specular component of reflection.

22. The device as defined in claim 21 and including a second light intensity detector arranged to detect intensity of light reflected from the imaging surface from the array of light sources at a position for the detection of the diffuse component of reflection.

23. The device as defined in claim 22 wherein the second light intensity detector comprises an array of photosensitive elements, each element producing a signal representative of light intensity detected over a period of time, and arranged for detection of light reflected from the surface as the light source is moved thereacross.

24. The device as defined in claim 23 including comparison means for comparing the ratio of specularly reflected light signal to diffusely reflected light signal to derive a constant value therefrom, invariant with contamination of light source, or light detectors.

25. In an electrostatographic device including a photoconductive imaging surface moving along a continuous path, means for creating a latent image on the imaging surface, means for developing the latent image with toner, means for imagewise transferring the toner to a second surface, a cleaner for removing residual toner remaining on the imaging surface after transfer; an erase lamp for dissipating charge remaining on the imaging surface; and a cleaner performance monitor comprising:

means for directing light from the erase lamp to a portion of the imaging surface between the cleaner and the latent image creating means; and a light intensity detector arranged to detect intensity of light reflected from the imaging surface from the erase lamp, and producing a signal indicative of the presence or absence of toner thereon.

26. The device as defined in claim 25 wherein the light directing means includes a lens arrangement supported to illuminate the imaging surface at a shallow angle.

27. The device as defined in claim 26 wherein the lens arrangement is supported to illuminate the imaging surface at an angle between 5° and 35°.

28. The device as defined in claim 25 wherein the light intensity detector is arranged to detect intensity of light reflected from the imaging surface from the light directing means at a position for detection of the specular component of reflection.

29. In an electrostatographic device including a photoconductive imaging surface moving along a continuous path; means for creating a latent image on the imaging surface including a charging station uniformly charging the imaging surface and a laser light source for discharging the imaging surface in imagewise configuration; means for developing the latent image with toner, means for imagewise transferring the toner to a second surface, a cleaner for removing residual toner remaining on the imaging surface after transfer; and a cleaner performance monitor comprising:

means for directing the laser light to a portion of the imaging surface; and a light intensity detector arranged to detect intensity of light reflected from the imaging surface from the laser light, and producing a signal indicative of the presence or absence of toner thereon.

30. The device as defined in claim 29 wherein the laser light directing means provides illumination of the imaging surface at a shallow angle.

31. The device as defined in claim 30 wherein the laser light directing means illuminate the imaging surface at an angle between 5° and 35°.

32. The device as defined in claim 29 wherein the light intensity detector is arranged to detect intensity of light reflected from the imaging surface from the laser light directing means at a position for detection of the specular component of reflection.

33. The device as defined in claim 32 including a second light intensity detector arranged to detect intensity of light reflected from the imaging surface from the laser light directing means at a position for the detection of the diffuse component of reflection.

34. In an electrostatographic device including an imaging surface, moving along a continuous path, means for creating a latent image on the imaging surface, means for developing the latent image with toner, means for imagewise transferring the toner to a second surface, a cleaner for removing residual toner remaining on the imaging surface after transfer; and a cleaner performance monitor comprising:

a light source arranged to illuminate the imaging surface at a shallow angle after the imaging surface is cleaned and before a latent image is developed on the imaging surface;

a light intensity detector arranged to detect intensity of light reflected from the imaging surface from the light source, and producing a signal indicative of the presence or absence of toner thereon.

35. The device as defined in claim 34 wherein the light source is arranged to illuminate the imaging surface at an angle between 5° and 35°.

36. The device as defined in claim 35 wherein the light intensity detector is arranged to detect intensity of light reflected from the imaging surface from the light source at a position for detection of the specular component of reflection.

37. In an electrostatographic device including an imaging surface, moving along a continuous path, means for creating a latent image on the imaging surface, means for developing the latent image with toner, means for imagewise transferring the toner to a second surface, a cleaner for removing residual toner remaining on the imaging surface after transfer; and a cleaner performance monitor comprising:

a light source arranged to illuminate the imaging surface after the imaging surface is cleaned and before a latent image is developed on the imaging surface;

a light intensity detector arranged to detect intensity of light reflected from the imaging surface from the light source, and producing a signal indicative of the presence or absence of toner thereon; and a comparator for comparing the signal from the light intensity detector with a predetermined reference value to determine whether the light intensity detector signal indicative of the presence or absence of toner indicates a cleaning failure.

38. The device as defined in claim 37 and including a summing means to sum the number of defects over time.

39. In an electrostatographic device including an imaging surface, moving along a continuous path, means for creating a latent image on the imaging surface, means for developing the latent image with toner, means for imagewise transferring the toner to a second surface, a cleaner for removing residual toner remaining on the imaging surface after transfer; and a cleaner performance monitor comprising:

a light source arranged to illuminate the imaging surface after the imaging surface is cleaned and before a latent image is developed on the imaging surface;

a light intensity detector arranged to detect intensity of light reflected from the imaging surface from the light source, and producing a signal indicative of the presence or absence of toner thereon; and a summing means to sum signals from the light intensity detector, to derive a cleaning failure signal representative of the total amount of toner on the imaging surface over time.

40. In an electrostatographic device including an imaging surface, moving along a continuous path, means for creating a latent image on the imaging surface, means for developing the latent image with toner, means for imagewise transferring the toner to a second surface, a cleaner for removing residual toner remaining on the imaging surface after transfer; and a cleaner performance monitor comprising:

a light source arranged to illuminate the imaging surface after the imaging surface is cleaned and before a latent image is developed on the imaging surface; and a light intensity detector arranged to detect the intensity of light illuminating the imaging surface, and producing a signal indicative of the presence or absence of toner thereon.

41. The device as defined in claim 40, wherein the imaging surface is at least semi-transparent, and one of the light source and light intensity detector is arranged on an opposite side of the imaging surface from the other.

* * * * *